US005393251A

United States Patent [19]

Gilbert

[11] Patent Number: 5,393,251

[45] Date of Patent: Feb. 28, 1995

[54] OUTBOARD MOTOR SUPPORT

[76] Inventor: Edward A. Gilbert, 3940 Gold St., Omaha, Nebr. 68105

[21] Appl. No.: 792,271

[22] Filed: Nov. 18, 1991

[51] Int. Cl.[6] ..... B63H 5/12

[52] U.S. Cl. ..... 440/59; 248/640

[58] Field of Search ..... 440/53, 63, 55, 59, 440/58, 61; 248/640, 641, 642, 354.4, 200.1

[56] References Cited

U.S. PATENT DOCUMENTS

| | | | |
|---|---|---|---|
| 596,722 | 1/1898 | Schneider | 248/200.1 |
| 1,347,148 | 7/1920 | Driscoll | 440/55 |
| 2,757,888 | 8/1956 | Branstrator | 248/641 |
| 2,893,342 | 7/1959 | Langford | 440/61 |
| 3,018,989 | 1/1962 | Gossett | 248/4 |
| 3,191,573 | 6/1965 | Hixon | 440/59 |
| 3,455,271 | 7/1969 | Becker | 440/59 |
| 3,941,344 | 3/1976 | Paterson | 248/351 |
| 4,311,471 | 1/1982 | Queen | 440/63 |
| 4,331,431 | 5/1982 | Estes | 440/53 |
| 4,501,561 | 2/1985 | Speelman | 440/61 |
| 4,651,964 | 3/1987 | Kendrick | 248/351 |
| 4,685,888 | 8/1987 | Brewer | 440/53 |
| 4,828,186 | 5/1989 | Weiss | 248/640 |
| 4,842,239 | 6/1989 | Kinsey et al. | 248/640 |
| 5,021,016 | 6/1991 | Currey | 440/113 |
| 5,031,842 | 7/1991 | Mohr | 248/640 |

*Primary Examiner*—Sherman Basinger
*Attorney, Agent, or Firm*—Larson and Taylor

[57] ABSTRACT

An improved motor support is provided which securely holds a motor in a predetermined position and has its length continuously adjustable over a range of lengths. The motor support comprises a first bracket which is attached to the bottom portion of a motor mount, a second bracket which is attached to the lower portion of an outboard motor, and an adjustable length support arm which is secured between the first and second bracket. In one embodiment, the brackets comprise T-shaped members having hollow channels in the base and threaded channels perpendicular to the hollow channels. Additionally, the adjustable length support arm may have a first and second threaded region at respective ends of said arm for attaching the arm to the brackets. These threaded regions may be utilized to adjust the overall length of the motor support.

18 Claims, 2 Drawing Sheets

OUTBOARD MOTOR SUPPORT

FIELD OF THE INVENTION

This invention relates generally to supports for outboard motors and more specifically, to an outboard motor support provided with a locking mechanism to prevent the motor from swinging freely, and a height adjustment means.

BACKGROUND OF THE INVENTION

When a motor boat having an outboard drive unit, such as an outboard motor, is transported by means of a trailer or the like, it is necessary to maintain the outboard drive unit in a tilted position to prevent the lower portion of the unit from contacting the ground during transportation. Irregularities such as bumps and potholes, in the road can cause the boat and trailer to bounce and thus cause the lower portion of the outboard motor to come into contact with the road surface. Therefore, sufficient clearance must be maintained between the lower portion of the drive unit and the road surface to compensate for such irregularities.

Additionally, in auxiliary powered sailboats, an outboard motor is utilized to power the ship to and from dock. When the ship is at sea, the motor must be tilted so that the drag exerted by the motor can be reduced. Therefore, an easily accessible device is required which will firmly secure the motor in this tilted position.

Several U.S. Patents disclose devices which provide the ability to elevate an outboard motor. U.S. Pat. No. 5,021,016 (Currey) discloses a spring loaded outboard motor support which at one end connects to the trailer and at the other to the outboard motor.

U.S. Pat. No. 4,651,964 (Kendrick) discloses a support rod for an outboard motor which is substantially U-shaped. This support rod engages a stationary portion of the outboard drive unit by pins which allow rotational movement of the support rod from an engaged position to a stored position.

U.S. Pat. No. 4,501,561 (Speelman) discloses a brace device for an outboard motor. The brace device is an elongated rod having at one end, a V-shaped bifurcated engagement portion for frictionally engaging the lower portion of an outboard motor and a U-shaped curved portion, at the other end, for frictionally engaging a support shaft in the wall members of the outboard motor.

U.S. Pat. No. 4,828,186 (Weiss) discloses a boat motor support which at one end connects to the trailer and at the other end frictionally engages the lower portion of the outboard motor. This device has telescoping shaft so that the height of the motor may be adjusted to suit the specific motor.

U.S. Pat. No. 4,331,431 (Estes) discloses a support arm assembly for boat trailers. The support arm is pivotally connected at one end to a boat trailer, and at the other end, a V-shaped segment frictionally engages a lower section of the outboard motor. A retaining strap is provided to secure the support arm to the motor. U.S. Pat. No. 3,941,344 (Paterson) discloses a similar device.

U.S. Pat. 4,685,888 (Brewer) discloses a shock arm which is disposed between a trailer mount and the lower portion of an outboard motor. A strap is affixed to the shock arm to secure it to the motor. A tilt mechanism is provided to return the shock arm from a compressed position to a support position.

U.S. Pat. No. 4,842, 239 (Kinsey et al.) discloses a motor support which at one end frictionally engages a trailer mount and at the other, frictionally engages a lip on the motor. The support is telescopically adjustable.

U.S. Pat. No. 5,031,842 (Mohr) discloses an adjustable motor support which mounts between a lower end of an outboard motor and the drain hole in the transom of a boat. The height of the support may be adjusted by two telescoping rods.

U.S. Pat. No. 3,018,989 (Gossett) discloses a stabilizing bracket for outboard motors. The bracket comprises a clamping member having a pair of horizontally spaced arms. The device functions by securing the bracket to the motor and inserting the arms into slots in the motor support located at the transom.

Although all of the above-discussed devices relate to motor supports, they have the disadvantage of not securely supporting the motor at a predetermined distance and angle. The above devices require friction to hold the motor in place and will fail if a severe bump is encountered. Additionally, the above discussed devices fail to provide the ability to continuously adjust the length of the support over a wide range of values.

Inasmuch as the art is relatively crowded with respect to these various types of motor supports, it can be appreciated that there is a continuing need for, and interest in, improvements to such motor supports. In this respect, the present invention addresses the needs and interests for a motor support which securely holds a motor in a predetermined position and is readily adjustable.

SUMMARY OF THE INVENTION

According to the invention, a motor support is provided which has the advantages of securely holding a motor in a predetermined position and having its length continuously adjustable over a range of lengths.

The motor support of the invention comprises a first bracket which is attached to the bottom portion of a motor mount, a second bracket which is attached to the lower portion of an outboard motor, and an adjustable length support arm which is secured between the first and second bracket. In one embodiment, the brackets comprise T-shaped members having hollow channels in the base and threaded channels perpendicular to the hollow channels. Additionally, the adjustable length support arm may have a first and second threaded region at respective ends of said arm for attaching the arm to the brackets. These threaded regions may be utilized to adjust the overall length of the motor support.

Other features and advantages of the invention will be set forth in, or apparent from, the following detailed description of the preferred embodiment of the invention.

DESCRIPTION OF THE PREFERRED EMBODIMENTS

Figure 1:
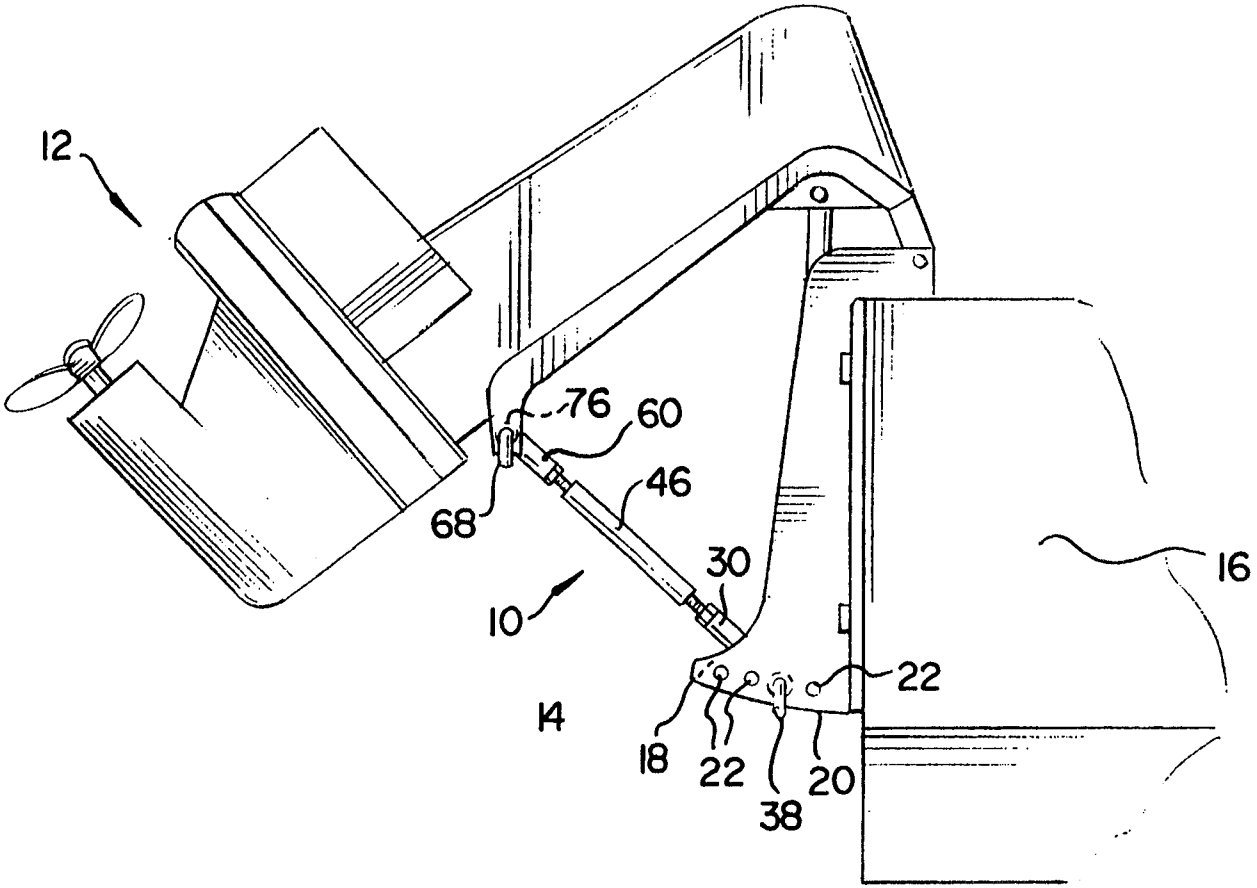
FIG. 1 is a side elevational view of a motor support constructed in accordance with a preferred embodiment of the invention.
Figure 2:
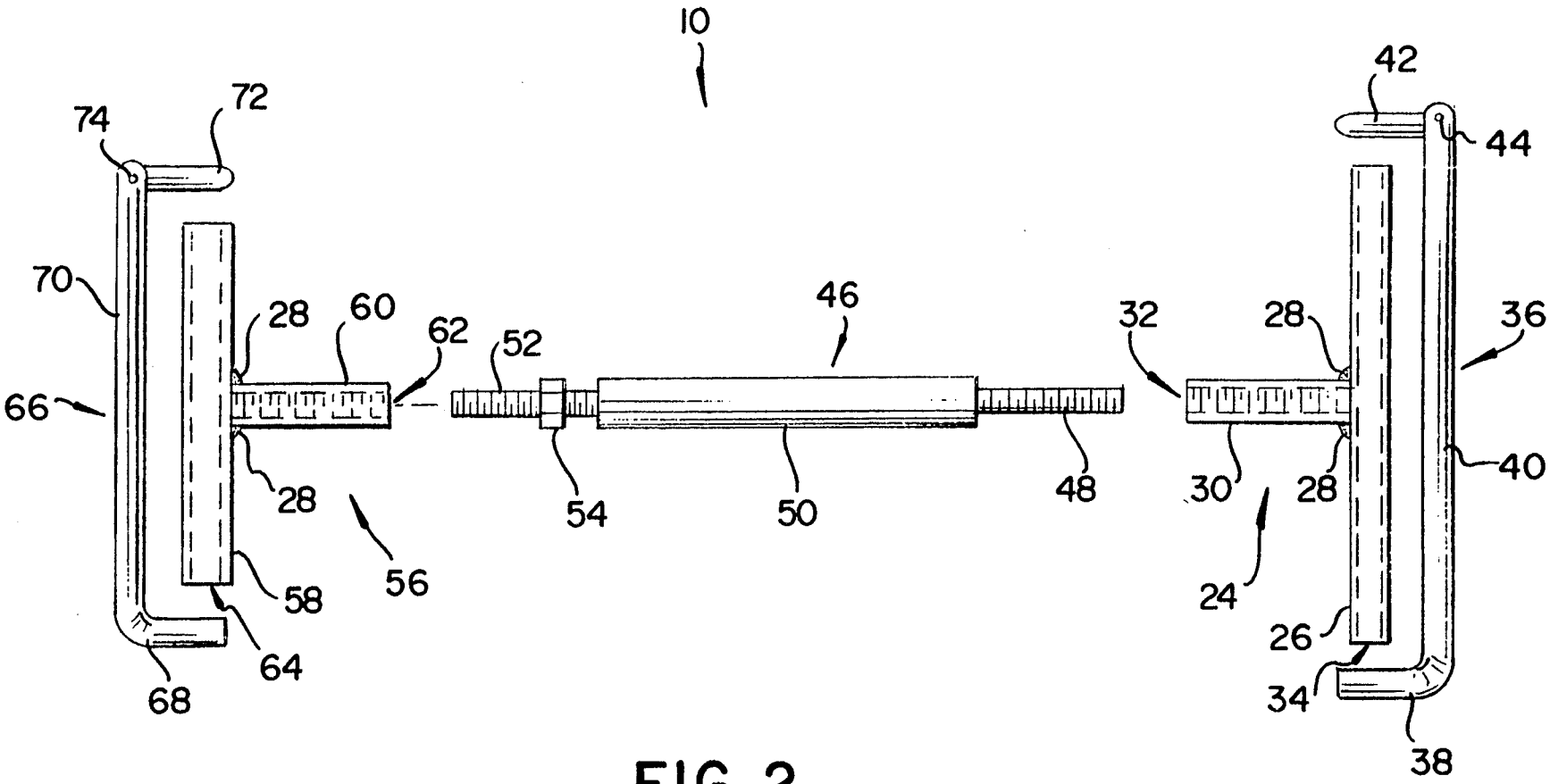
FIG. 2 is an exploded top view of the motor support of FIG. 1.

Referring to FIGS. 1 and 2, a motor support, generally denoted 10, is illustrated. The motor support 10, secures the lower portion of an outboard motor 12 to the motor mount 14 which is attached to the transom 16 of the boat. In a preferred embodiment, all elements of motor mount 10 are made of a material that will resist corrosion. The motor mount 10 has two parallel arms 18, and 20 with uniform holes 22 along the periphery of the arms 18 and 20. A T-shaped bracket 24 is placed between arms 18 and 20 and is aligned with holes 22 in the arms 18 and 20.

The T-shaped bracket comprises a hollow tube or cylinder 26 which is attached, by welds 28, to a base tube or cylinder 30. Cylinder 30 has a threaded channel 32, which is preferably left hand threaded. Cylinder 26 has a channel 34 for allowing a bolt 36 to be placed therein.

Bolt 36 has a wedge shaped end 38 for preventing the bolt. 36 from sliding completely through channel 34 and respective holes 22. Attached to the wedge shaped end 38, is a rod 40. The outside diameter of rod 40 corresponds to the inside diameter of channel 34. At the distal end of rod 40 is a finger 42 which is mounted on rod 40 by a pivot 44. In a preferred embodiment, finger 42 is maintained in a position perpendicular to the rod 40 by a spring or any other means known in the art. The T-shaped bracket 24 is secured to both arms 18 and 20 by aligning the channel 34 with corresponding holes 22. Then bolt 36 is placed through one of the holes 22 and in channel 34 by pivoting finger 42 so that the axial centerline of finger 42 aligns with the axial centerline of rod 40. Then the bolt 36 is placed within channel 34 so that the wedge shaped end 38 abuts cylinder 26. Next, the finger 42 is repositioned so that the axial centerline of finger 42 is perpendicular to the axial centerline of rod 40.

A dowel or support arm 46 is used to maintain the motor 12 at a predetermined distance and angle of orientation from the boat. Dowel 46 has a left hand threaded region 48. The threads on region 48 correspond to the threaded channel 32. The dowel 46 has a handle region 50 which may be roughened to aid in gripping dowel 46. Attached to the other end of handle region 50 is a right handed threaded region 52. It should be noted that by utilizing threaded regions, small adjustments to the length of motor support 10 may be made. A nut 54 engages the threads in region 52 and is used as a limiting means, as described below.

A second T-shaped bracket 56 secures dowel 46 to a fastener 76 on the motor 12. Bracket 56 is similar to bracket 24 and has a hollow tube or cylinder 58, a base tube or cylinder 60, a threaded channel 62 and a channel 64 which correspond to and function similarly to elements 26, 30, 32 and 34, respectively. There are several differences in these elements. For example, cylinder 58 has a larger diameter than that of cylinder 26. Additionally, threaded channel 62 is right hand threaded to correspond to threaded region 52.

A second bolt 66 is similar to bolt 36 and comprises a wedge shaped end 68, a rod 70, a finger 72 and a pivot 74. Elements 68, 70, 72 and 74 correspond to and function similarly to elements 38, 40, 42 and 44, respectively. The only difference is that the outside diameter of rod 70 is larger than that of rod 40. Bolt 66 is utilized to secure bracket 56 to a fastener 76 on the motor 12.

Considering the overall operation of the motor support 10, nut 54 is adjusted to a predetermined position so that the motor 12 may be maintained at a particular distance and angle from the boat. Next, the T-shaped bracket 56 is threaded onto region 52 so that the bracket comes into contact with the nut 54. Then, the T-shaped bracket 24 is attached to the arms 18 and 20 as described above. Next, the threaded region 48 is threaded into channel 32. Finally, the bolt 66 is placed through bracket 56 and fastener 76 so that the motor 12 is securely fastened to the motor support 10.

Although the present invention has been described relative to specific exemplary embodiments thereof, it will be understood by those skilled in the art that variations and modifications can be effected in these exemplary embodiments without departing from the scope and spirit of the invention.

What is claimed is:

1. An outboard motor support for supporting a motor mounted on a transom of a boat by a motor mount, in an elevated position, the motor support comprising:

a first bracket attachable to said motor mount, said first bracket comprises a T-shaped member, said member having a first hollow channel in the base of said T-shaped member and having a first threaded channel perpendicular to said first hollow channel;

a second bracket attachable to said motor;

an adjustable length support arm, said adjustable length support arm has first and second threaded regions at ends of said arm and said first and second brackets have threaded receiving means for receiving threaded regions of said support arm; and means for securely attaching said adjustable length support arm to said first and second brackets.

2. The device recited in claim 1 wherein said first and second threaded regions are oppositely threaded.

3. The device recited in claim 1 further comprising a means for limiting the length of said motor support.

4. The device recited in claim 3 wherein said means for limiting comprises a nut threaded on said support arm for preventing one of said brackets from being completely threaded on said support arm.

5. The device recited in claim 1 further comprising:

a means for securing said first bracket to a bottom portion of said motor mount; and a means for securing said second bracket to a bottom portion of said motor.

6. The device recited in claim 5 wherein said means for securing said first bracket comprises a bolt having a wedge shaped member at one end and a pivotal finger at the distal end.

7. The device recited in claim 6 wherein said pivotal finger is biased to be perpendicular to said bolt.

8. The device recited in claim 5 wherein said means for securing said second bracket comprises a bolt having a wedge shaped member at one end and a pivotal finger at the distal end.

9. The device recited in claim 8 wherein said pivotal finger is biased to be perpendicular to said bolt.

10. An outboard motor support for supporting a motor mounted on a transom of a boat in an elevated position, the motor support comprising:

a first bracket attachable to a bottom portion of an outboard motor mount, said first bracket comprising a first T-shaped member, said member having a first hollow channel perpendicular to a first threaded channel;

a means for securing said first bracket to said bottom portion of an outboard motor mount;

a second bracket attachable to the lower portion of an outboard motor, said second bracket comprising a second T-shaped member, said member having a second hollow channel perpendicular to a second threaded channel;

a means for securing said second bracket to said lower portion of an outboard motor;

a support arm having a first and second threaded region at respective ends of said arm, said first and second threaded regions for engaging said first and second threaded channels, respectively.

11. An outboard motor support for supporting a motor mounted on a transom of a boat by a motor mount, in an elevated position, the motor support comprising:

a first bracket attachable to said motor mount;

a second bracket attachable to said motor, said second bracket comprising a T-shaped member, said member having a hollow channel in the base of said T-shaped member and having a threaded channel perpendicular to said hollow channel;

an adjustable length support arm, said adjustable length support arm has first and second threaded regions at ends of said arm and said first and second brackets have threaded receiving means for receiving threaded regions of said support arm; and means for securely attaching said adjustable length support arm to said first and second brackets.

12. The device recited in claim 11 wherein said first and second threaded regions are oppositely threaded.

13. The device recited in claim 11 further comprising a means for limiting the length of said motor support.

14. The device recited in claim 11 further comprising:

a means for securing said first bracket to a bottom portion of said motor mount; and a means for securing said second bracket to a bottom portion of said motor.

15. The device recited in claim 14 wherein said means for securing said first bracket comprises a bolt having a wedge shaped member at one end and a pivotal finger at the distal end.

16. The device recited in claim 15 wherein said pivotal finger is biased to be perpendicular to said bolt.

17. The device recited in claim 14 wherein said means for securing said second bracket comprises a bolt having a wedge shaped member at one end and a pivotal finger at the distal end.

18. The device recited in claim 17 wherein said pivotal finger is biased to be perpendicular to said bolt.

* * * * *